United States Patent [19]

Mitschik

[11] Patent Number: 4,740,769

[45] Date of Patent: Apr. 26, 1988

[54] ELECTROMAGNETIC RELAY

[75] Inventor: Herbert Mitschik, Geretsried, Fed. Rep. of Germany

[73] Assignee: Siemens Aktiengesellschaft, Berlin and Munich, Fed. Rep. of Germany

[21] Appl. No.: 55,499

[22] Filed: May 28, 1987

[30] Foreign Application Priority Data

Jun. 23, 1986 [DE] Fed. Rep. of Germany ..... 3620937

[51] Int. Cl.[4] ..... H01H 51/22

[52] U.S. Cl. ..... 335/83; 335/78; 335/121

[58] Field of Search ..... 335/78, 79, 80, 81, 335/83, 121, 124, 128, 129, 131, 133

[56] References Cited

U.S. PATENT DOCUMENTS 3,295,078 12/1966 Hrynewycz ..... 335/128
4,199,740 4/1980 Woods ..... 335/128

FOREIGN PATENT DOCUMENTS 0202651 11/1986 European Pat. Off. .
3437544 4/1986 Fed. Rep. of Germany .
769391 8/1934 France .

OTHER PUBLICATIONS

U.S. Ser. No. 858,921 (corresponding to German application P 35 38 613.4).
European Search Report.

*Primary Examiner*—E. A. Goldberg
*Assistant Examiner*—Lincoln Donovan
*Attorney, Agent, or Firm*—John Francis Moran

[57] ABSTRACT

A relay includes a spool, or coil (3 and 4), and a yoke (5) next to the spool. In front of the spool, an armature (8) that activates a contact spring (16) is accomodated in a contact space positioned upstream in one of the free sides of the armature. The contact spring has an initial leg (16*a*) extending straight across the overall width of the relay and a U-shaped second leg (16*b*) mounted on the first. The free end of the U-shaped spring leg (16*b*) operates in conjunction with two reciprocal-contact elements (13 and 14). The generally Y shape results in a contact spring (16) with a maximum possible free length and hence a low spring constant, meaning a low relay-response output, while retaining the prescribed compact design.

16 Claims, 1 Drawing Sheet

ELECTROMAGNETIC RELAY

BACKGROUND OF THE INVENTION

This invention relates to electromagnetic relays of the type operated by a coil, and it relates, more particularly, to relays wherein the axis of the coil parallels the plane of support and has a core extending through it. In this type of relay, a yoke is usually positioned adjacent to a winding and parallel to the axis of the coil wherein an armature and system of contacts is disposed at one end of the coil.

A typical relay of this general configuration and kind is the subject of a prior German patent application, No. P 35 38 613.4. Specifically, this type design is appropriate for relays that, although small, feature a high-voltage current contact. The overall width of the relay is occupied by the coil and its adjacent yoke, and to keep it from exceeding a prescribed size limit, the actual contact system is positioned in front of both the coil and the armature.

This relay configuration occasions a problem. The contact spring must, on the one hand, be capable of conducting a powerful current and must accordingly have an adequate cross-section. In other words, it must be fairly wide. Nevertheless, its spring rate, on the other hand, must be as low as possible to maintain the force to be exerted by the armature and, hence, the breaking capacity of the relay itself as low as possible. The result is that the contact spring must be as long as possible to keep the spring rate low. The contact spring in the relay disclosed in the foregoing cited prior application is accordingly inserted in a channel created by the yoke in such a way that one section of the spring parallels the axis of the coil. The drawback is that the empty space, or air gap, required to accomodate the motion also adds to the overall width of the relay.

SUMMARY OF THE INVENTION

An object of the present invention is therefore to improve a relay of the general type previously described to the extent that the spring constant of the contact spring will be as low as possible without increasing the overall width of the relay.

This object is achieved in accordance with the principles of the invention by an illustrative relay configuration wherein the contact spring is secured at one side, the side that is adjacent to the armature mount, of the base structure, an initial leg of the spring extends essentially over the total width of the inside of the relay, and the spring is connected to the free end of the armature at the other end of the base structure, in that the contact points are in the region near the second side of the base structure, and in that another leg of the contact spring extends in the shape of a U from the free end of the armature to at least one contact point.

Fastening the first leg of the spring to one longitudinal side of the relay and connecting it to the armature at the other longitudinal side makes all the remaining width of the relay available to accomodate the spring. The second, U-shaped, leg of the spring transmits the motion of the armature to the point of contact. The L-shaped or Z-shaped initial section of the spring plus the subsequent U-shaped section results in a generally Y-shaped, or bifurcated spring, which fully utilizes, or optimally exploits, the available contact space, attaining a spring constant that is as low as possible in the least possible space while ensuring adequate creep and air gaps between the point of contact and armature for switching strong, for example, high-voltage currents. The U-shaped second leg of the spring shifts the contact point out of the plane that the armature is mounted in, resulting in a relatively high level of friction that makes the contacts self-cleaning and protects them from impact.

The first and second legs of the contact spring may, for example, be made out of a single piece of uniformly thick resilient material. Since it is desirable for the U-shaped second leg to have a higher spring constant than the first leg, the second leg can be somewhat reinforced with beads or other types of elevation.

It is, however, also possible for the two legs to be made out of different leaf-spring materials and fastened together by welding or similar measures. The legs may be made out of materials with different spring properties or even out of resilient sheet metals of different thickness. It is also possible to provide the second leg with a cross-section that will allow it to successfully conduct heat (from switching arcs) away from the contact. Some of this heat can be conducted from the second spring leg to the armature to prevent thermal stress on the first leg.

BRIEF DESCRIPTION OF THE DRAWING

Features of the invention and additional objects of the invention will be more readily appreciated and better understood by reference to the following detailed description which should be considered in conjunction with the drawing.

DETAILED DESCRIPTION

Figure 1:
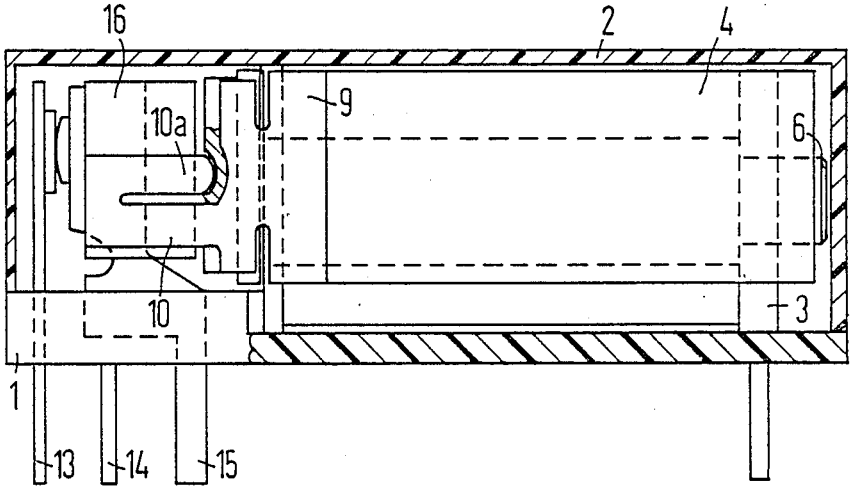
FIG. 1 is a side view of a relay in accordance with an illustrative embodiment of the invention wherein the housing is partly depicted in sectional form.
Figure 2:
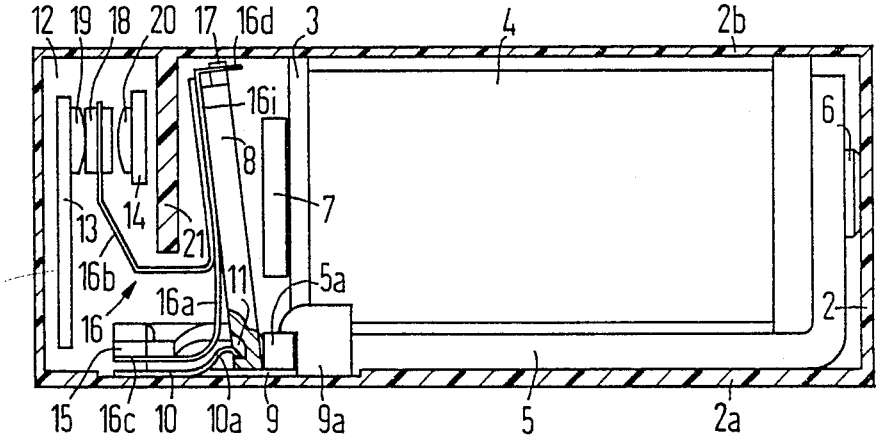
FIG. 2 is a top view of the relay illustrated in FIG. 1 with the housing cap in section.

The relay configuration illustrated in FIGS. 1 and 2 has a housing that includes a base 1 and a cap 2 accomodating a spool form 3 with a winding 4 and a curved yoke 5. One end of the spool 3, core 6 is connected to yoke 5. At the other end of the spool 3 is a pole plate 7 that constitutes, in conjunction with a flat armature 8, an operating air gap. Armature 8 is mounted on the free end of yoke 5, and a bearing plate 9 rests on the yoke and constitutes, in conjunction with it, a mounting notch. Bearing plate 9 is suspended from lugs **5*a* on the yoke by means of snap-in tabs 9*a* shaped onto its sides. On the free end of bearing plate 9, which is constructed out of a resilient ferromagnetic material, is a bearing spring 10. One section 10*a* of bearing spring 10 is bent up and engages a notch 11 in yoke 5**, forcing it into position.

The width of the relay is dictated by the diameter of spool 3 and 4 and the thickness of yoke 5, which are adjacent and occupy the total width between the two side walls of housing cap 2. In front of pole plate 7 and armature 8 is a contact space 12 that accomodates two reciprocal-contact elements 13 and 14 and a connection element 15 for a center contact spring 16. These three elements are secured in, for example, plugged into base 1.

Center contact spring 16 has two spring legs. A first spring leg **16*a* is essentially straight and bent into the shape of a Z at the ends. A second spring leg 16*b*** is generally U-shaped. Contact-spring connection element 15 is positioned as near one side wall 2a of cap 2 as possible and extends parallel with it. Spring leg 16a is secured by means of a bent attachment section 16c to the outside of connection element 15, resulting in a maximum resilient length between that section and the free end of armature 8, which is provided with a carrier tooth 17.

A feature of this relay configuration is that the width of the relay is accordingly extensively utilized for accomodating contact spring 16. One end 16d of spring leg 16a is connected, welded for example, to U-shaped spring leg 16b in the vicinity of the free end of armature 8. One end of the U-shaped spring leg 16b is provided with a bent carrier tab 16e, by means of which it is suspended in the carrier tooth 17 on armature 8. A central contact 18 is positioned on the other end of U-shaped contact-spring leg 16b and operates in conjunction with reciprocal contacts 19 and 20.

Since it is intended to conduct heavy currents, contact spring 16 must have an extensive cross-section, and this is attained by means of a considerable width perpendicular to the plane of projection of FIG. 22. When the two spring legs 16a and 16b are manufactured separately and then connected, they can be made out of the same resilient material and differ in thickness or out of different materials with different spring properties. It is important for spring leg 16a to have a low spring constant and for spring leg 16b to have a higher spring constant. This may in some cases be also attained by means of additional beads or other structures, especially when the both springs legs 16a and 16b are shaped out of the same material or made in one piece. It may also be practical for the purpose of conducting heavy currents to attach connection element 15 directly to moving central contact 18 by means of a flexible cord in order to prevent excessive stress on contact spring 16.

The requisite creep gap and air gap between reciprocal contact 20 and armature 8 are attained by means of a partition in the housing. Although the partition in the illustrative embodiment is shaped to be contained in the cap, it may be provided on the base in other embodiments.

There has thus been shown and described a novel electromagnetic relay which fulfills all the objects and advantages sought therefor. Many changes, modifications, variations and other uses and applications of the subject invention will, however, become apparent to those skilled in the art after considering this specification and the accompanying drawing which disclose the preferred embodiments thereof. All such changes, modifications, variations and other uses and applications which do not depart from the spirit and scope of the invention are deemed to be covered by the invention which is limited only by the claims which follow.

I claim:

1. An electromagnetic relay including coil, having an axis extending parallel to a support plane and a core extending through it, the relay comprising:

(a) a yoke positioned laterally and adjacent to an exterior winding of the coil and parallel to the axis of the coil, the yoke lying on a base structure of the relay;

(b) a flat armature pivotally mounted to extend over a free end of the yoke and constitutes, in conjunction with a free end of the core, an operating air gap;

(c) a system of contacts positioned to one side of the armature opposite to the side facing the coil including at least one fixed and at least one reciprocating contact element, the reciprocating contact element having a contact spring operating in response to the armature and the contacts having terminal elements secured in the base structure;

(d) the contact spring being secured to a first side, said first side being adjacent to the armature mount, of the base structure;

(e) a first leg of the spring having a length extending essentially coextensive with the total width of the inside of the relay from said first side of the base structure to a second side opposite to said first side, and the base structure having a width essentially corresponding to the diameter of the coil plus a lateral dimension of the yoke adjacent to the coil; said width also being the overall width of the relay;

(f) the contact spring connected to a movable end of the armature located near said second side of the base structure, contact points between said contact spring and said at least one fixed contact element of the system of contacts are located in a region near the second side of the base structure; and (g) a second leg of the contact spring extending in the shape of a U from the movable end of the armature to at least one reciprocating contact element.

2. An electromagnetic relay according to claim 1, wherein the first and second leg of the contact spring are bifurcations of a single piece.

3. An electromagnetic relay according to claim 1, wherein the first legs of the contact spring comprises a soft resilient material and the second leg comprises a hard resilient material.

4. An electromagnetic relay in accordance with claim 1, wherein the spring constant of the first leg of the contact spring is, due to its having a different cross-section, smaller than the second leg.

5. An electromagnetic relay in accordance with claim 2, wherein the spring constant of the first leg of the contact spring is, due to its having a different cross-section, smaller than the second leg.

6. An electromagnetic relay in accordance with claim 1, wherein the contacting end of the contact spring is also connected to its connection element through a flexible conducting element.

7. An electromagnetic relay in accordance with claim 1, wherein the second spring leg is reinforced with beads.

8. An electromagnetic relay in accordance with claim 1, wherein the connection element for the contact spring is secured in the base with its major plane parallel to the longitudinal side of the base and in that the contact spring is secured to the outside of the connection element.

9. An electromagnetic relay in accordance with claim 2, wherein the second spring leg is reinforced with beads.

10. An electromagnetic relay in accordance with claim 2, wherein the connection element for the contact spring is secured in the base with its major plane parallel to the longitudinal side of the base and in that the contact spring is secured to the outside of the connection element.

11. An electromagnetic relay in accordance with claim 2, wherein the contacting end of the contact spring is also connected to its connection element through a flexible conducting element.

12. An electromagnetic relay in accordance with claim 3, wherein the spring constant of the first leg of the contact spring is, due to its having a different cross-section, smaller than the second leg.

13. An electromagnetic relay in accordance with claim 3, wherein the contacting end of the contact spring is also connected to its connection element through a flexible conducting element.

14. An electromagnetic relay in accordance with claim 3, wherein the second spring leg is reinforced with beads.

15. An electromagnetic relay in accordance with claim 3, wherein the connection element for the contact spring is secured in the base with its major plane parallel to the longitudinal side of the base and in that the contact spring is secured to the outside of the connection element.

16. An electromagnetic relay in accordance with claim 4, wherein the second spring leg is reinforced with beads.

* * * * *